US009666016B1

(12) United States Patent
Sepulveda et al.

(10) Patent No.: US 9,666,016 B1
(45) Date of Patent: May 30, 2017

(54) SYSTEM AND METHOD FOR CONDUCTING CASINO STYLE GAME UTILIZING A PAIR OF SPINNING TOPS

(71) Applicant: Red Chair Gaming, LLC, Trinidad, CO (US)

(72) Inventors: Jeffery J. Sepulveda, Trinidad, CO (US); Martin P. Schrepfer, Trinidad, CO (US)

(73) Assignee: Red Chair Gaming, LLC, Trinidad, CO (US)

( * ) Notice: Subject to any disclaimer, the term of this patent is extended or adjusted under 35 U.S.C. 154(b) by 142 days.

(21) Appl. No.: 14/295,058

(22) Filed: Jun. 3, 2014

(51) Int. Cl.
*A63F 5/04* (2006.01)
*G07F 17/32* (2006.01)

(52) U.S. Cl.
CPC ..... *G07F 17/32* (2013.01)

(58) Field of Classification Search
None
See application file for complete search history.

(56) References Cited

U.S. PATENT DOCUMENTS

| | | | |
|---|---|---|---|
| 76,572 | A | 4/1868 | Wight |
| 459,832 | A | 9/1891 | Byram |
| D21,753 | S | 8/1892 | Huntoon |
| 680,957 | A | 8/1901 | Backus |
| 897,137 | A | 8/1908 | Perkins |
| 1,321,589 | A | 11/1919 | Behringer |
| D60,587 | S | 3/1922 | Striker |
| 1,452,618 | A | 4/1923 | Sayers |
| 1,469,151 | A | 9/1923 | Bartram |
| 1,522,189 | A | 1/1925 | Jacovatoes et al. |
| 1,529,263 | A | 3/1925 | McGinnis |
| 1,546,451 | A | 12/1925 | Meyers |
| 1,565,669 | A | 12/1925 | O'Reilly |
| 2,023,297 | A | 12/1935 | Vandegrift |
| 2,311,453 | A | 2/1943 | McKeown |
| D162,100 | S | 2/1951 | Wee |
| 2,583,805 | A | 1/1952 | Astle |
| 2,775,458 | A | 12/1956 | Raymond |
| 2,794,644 | A | 6/1957 | Johnson |
| 2,976,045 | A | 3/1961 | Mason |
| 3,037,258 | A | 6/1962 | Anderson |
| D196,801 | S | 11/1963 | Friedman |
| 3,136,460 | A | 6/1964 | Ruderian |
| 3,693,977 | A | 9/1972 | De Keller |
| 4,299,392 | A | 11/1981 | Tammen |

(Continued)

*Primary Examiner* — Jason Yen
(74) *Attorney, Agent, or Firm* — FisherBroyles, LLP; Rob L. Phillips

(57) ABSTRACT

A casino style system and method involving the use of a pair of spinning tops to generate random outcomes. A dealer's top and player's top are spun simultaneously before which players are able to place wagers on a series of colors (e.g., red, green, blue and yellow) and/or symbols (e.g., wild jokers) depicted on different facets of the tops and win awards responsive to random outcomes generated by said tops once toppling over. The tops are adapted to land such that a single facet is facing upwards identifying a color/symbol. Players may be able to place combo outcome wagers on specific combinations of random outcomes generated by the tops. A calibration/balance device is used to check and maintain the randomness of the tops.

4 Claims, 12 Drawing Sheets

(56) References Cited

U.S. PATENT DOCUMENTS

| | | | | |
|---|---|---|---|---|
| 4,834,372 | A * | 5/1989 | Velazquez | A63F 9/16 273/147 |
| 4,856,784 | A | 8/1989 | Magee | |
| 5,570,885 | A | 11/1996 | Ornstein | |
| 5,848,936 | A * | 12/1998 | Morrison | A63F 3/00157 273/147 |
| 6,286,834 | B1 * | 9/2001 | Caputo | A63F 9/0406 273/146 |
| 2001/0028147 | A1 * | 10/2001 | Ornstein | A63F 3/00157 273/292 |
| 2011/0092266 | A1 * | 4/2011 | Kitamura | G07F 17/32 463/16 |

* cited by examiner

SYSTEM AND METHOD FOR CONDUCTING CASINO STYLE GAME UTILIZING A PAIR OF SPINNING TOPS

FIELD OF THE INVENTION

The embodiments of the present invention relate to a system and method involving a pair of spinning tops to generate random outcomes on which players can place wagers.

BACKGROUND

Casino gaming continues to expand throughout the world. The Internet and mobile devices have accelerated the growth of gaming. While there are numerous popular games of chance in the market, it would be beneficial to develop a gaming system and method involving spinning tops to generate random outcomes.

Thus, it would be advantageous to develop a system and method for conducting a casino style game utilizing a pair of spinning tops to generate random outcomes upon which players may place wagers. Beneficially, the game is played upon a gaming table akin to a blackjack table. Virtual spinning tops may also be used in a digital, virtual or online environment.

SUMMARY

The embodiments of the present invention are broadly related to a casino style system and method involving the use of a pair of spinning tops to generate random outcomes. In one embodiment, players are able to place wagers on a series of colors (e.g., red, green, blue and yellow) and/or symbols (e.g., wild jokers) depicted on different facets of the tops and win an award responsive to colors of said series of colors being identified by the tops once they stop spinning and topple over. The tops are adapted to land such that a single facet is facing upwards identifying a color/symbol. In another embodiment, players are able to place combo wagers based on specific outcomes of both tops.

A gaming table facilitates a live embodiment of the game. In one embodiment, the gaming table depicts wager areas and corresponding odds. In one embodiment, wager areas are illuminated to highlight the colors/symbols which the wager area represents. Means for recording game outcomes allow for tracking multiple consecutive game outcomes.

The embodiments of the present invention are suitable for live gaming tables or may be distributed via electronic formats such as a standalone gaming machines, gaming machine networks, smart phones, tablets and computer terminals.

Other variations, embodiments and features of the present invention will become evident from the following detailed description, drawings and claims.

DETAILED DESCRIPTION

Figure 1:
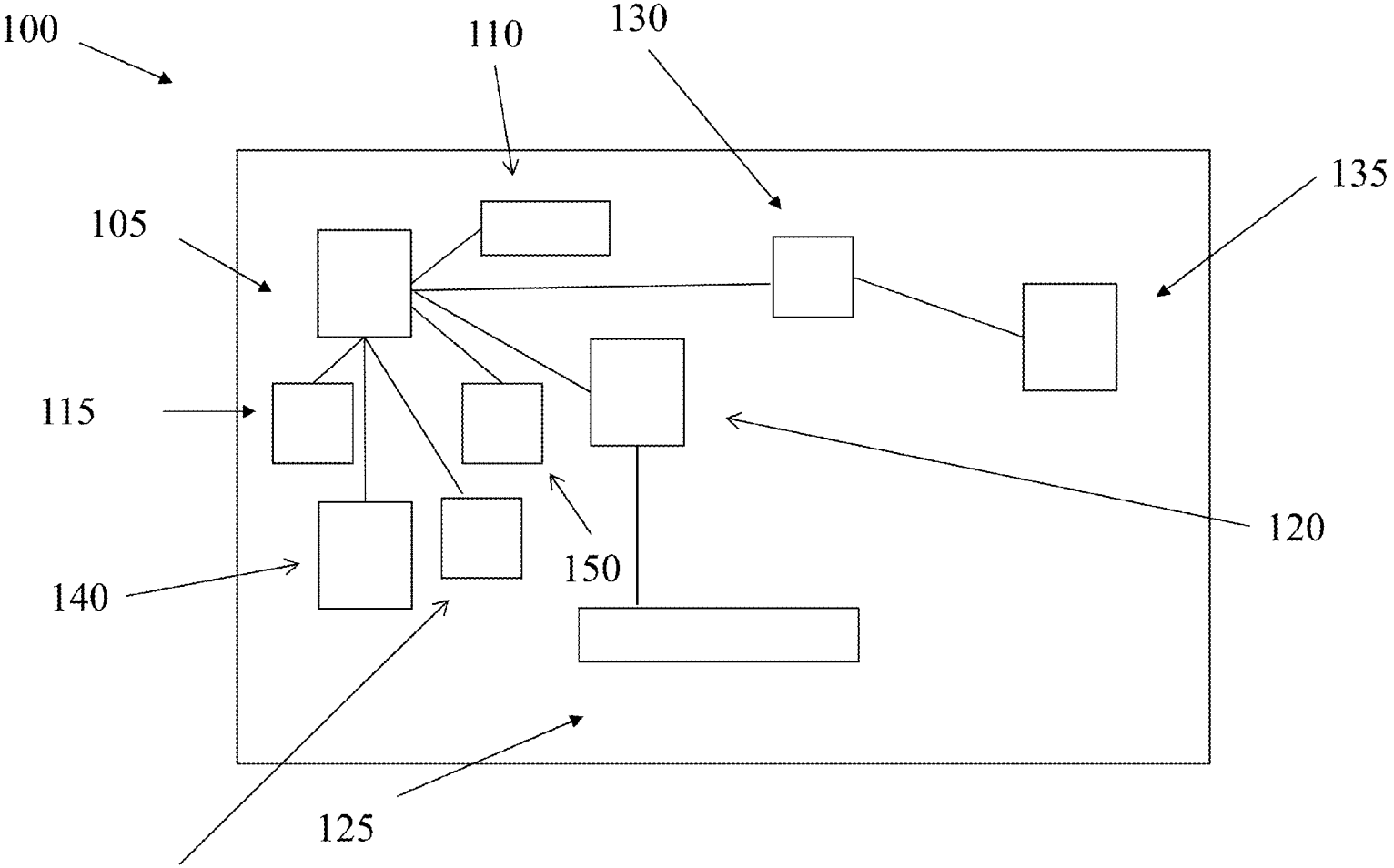
FIG. 1 illustrates a block diagram of an electronic gaming device of the type which may facilitate electronic embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the virtual, digital and online embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" and "gaming machine" should be understood to be any one of a general purpose computer, as for example a personal computer or a laptop computer, a client computer configured for interaction with a server, a special purpose computer such as a server, or a smart phone, tablet computer, personal digital assistant or any other machine adapted for executing programmable instructions in accordance with the description thereof set forth herein.

In addition to gaming tables, the embodiments of the present invention may be facilitated by an electronic gaming device whereby multiple players play against one another under the control of a central server as described herein. Besides mobile devices, the electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
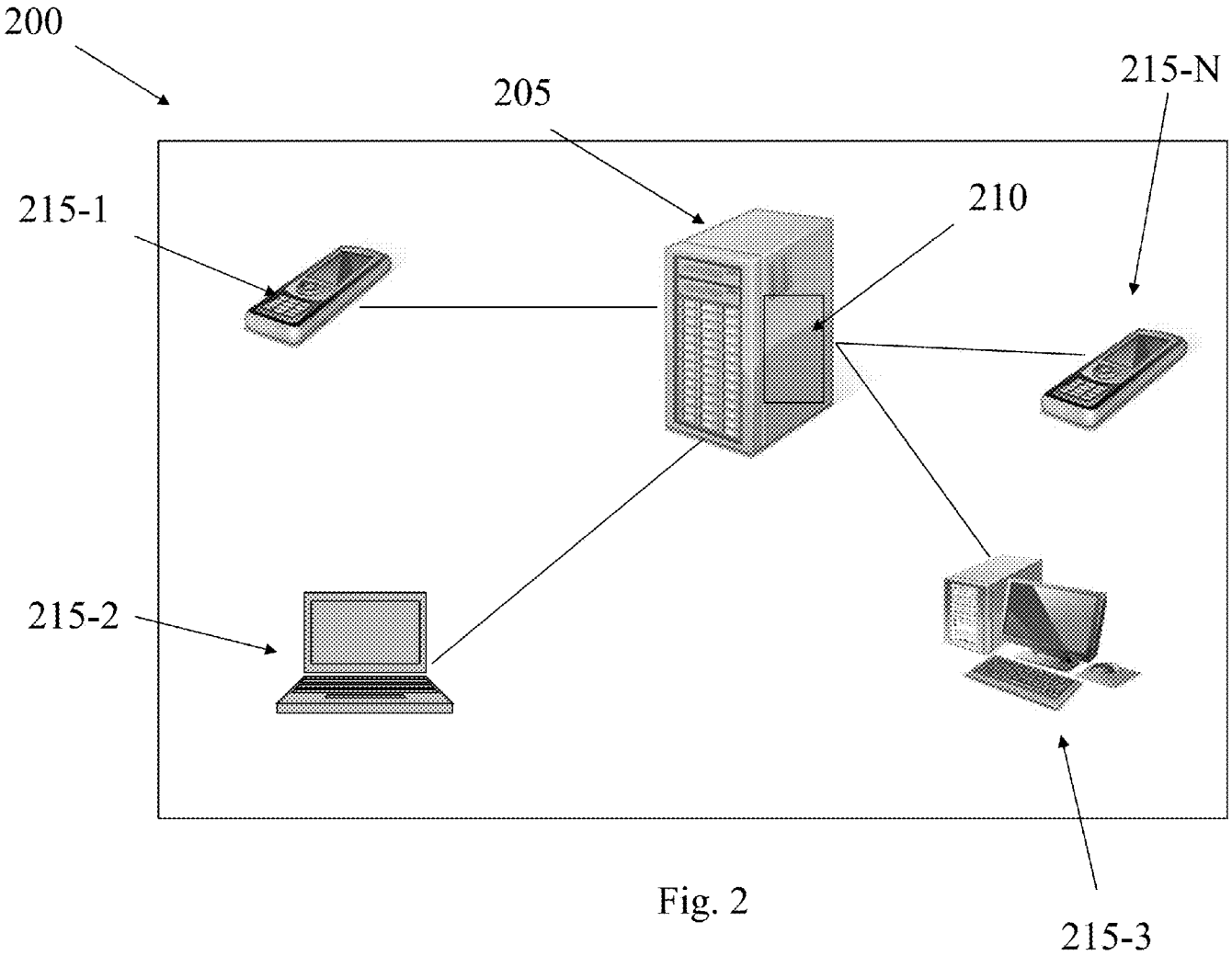
FIG. 2 shows a block diagram of a wireless system which may be used to facilitate remote play of the game according to the embodiments of the present invention.
Figure 3A:
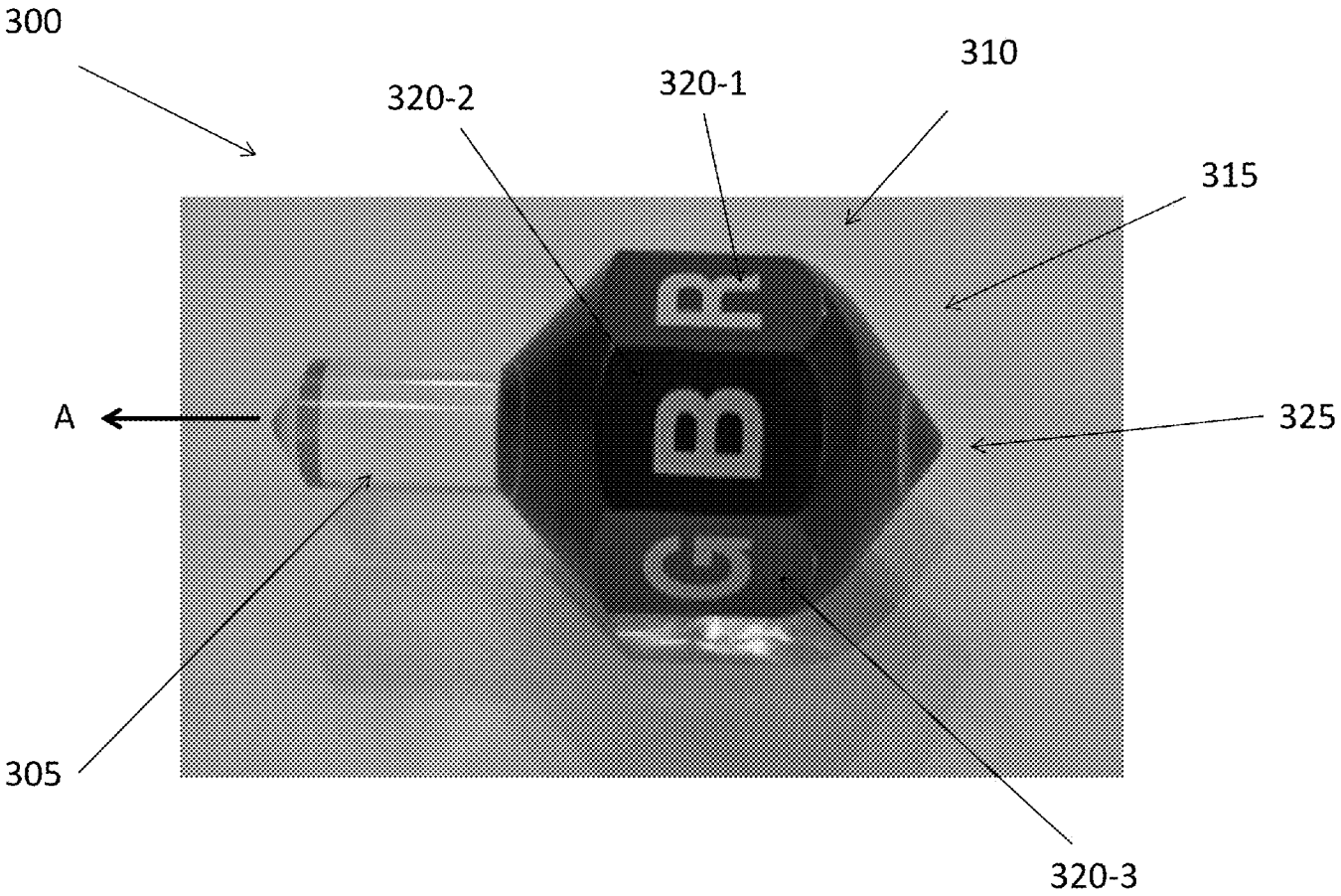
FIGS. 3A-3D illustrate various views of a top utilized to generate random game outcomes according to the embodiments of the present invention.
Figure 3B:
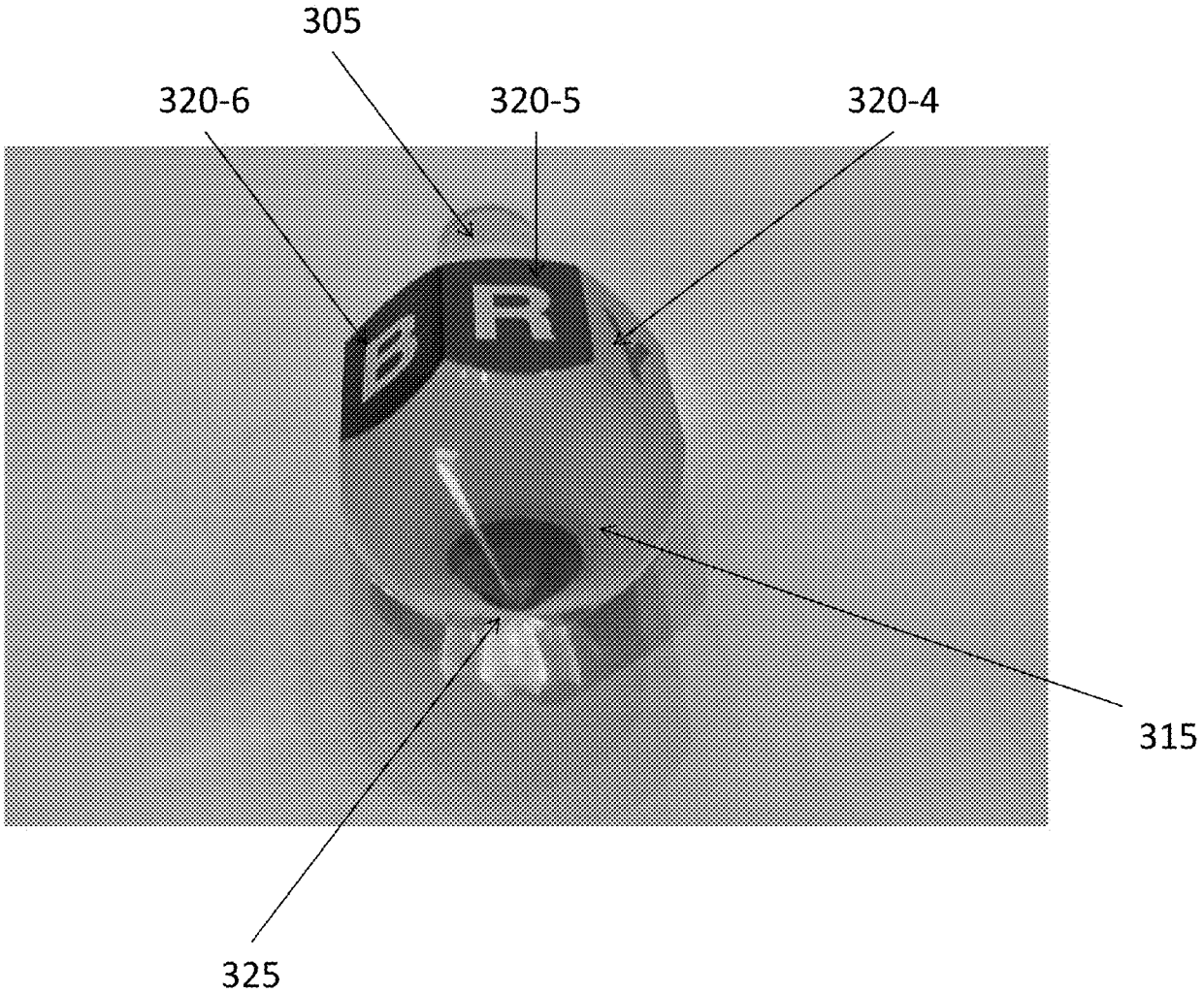
Figure 3C:
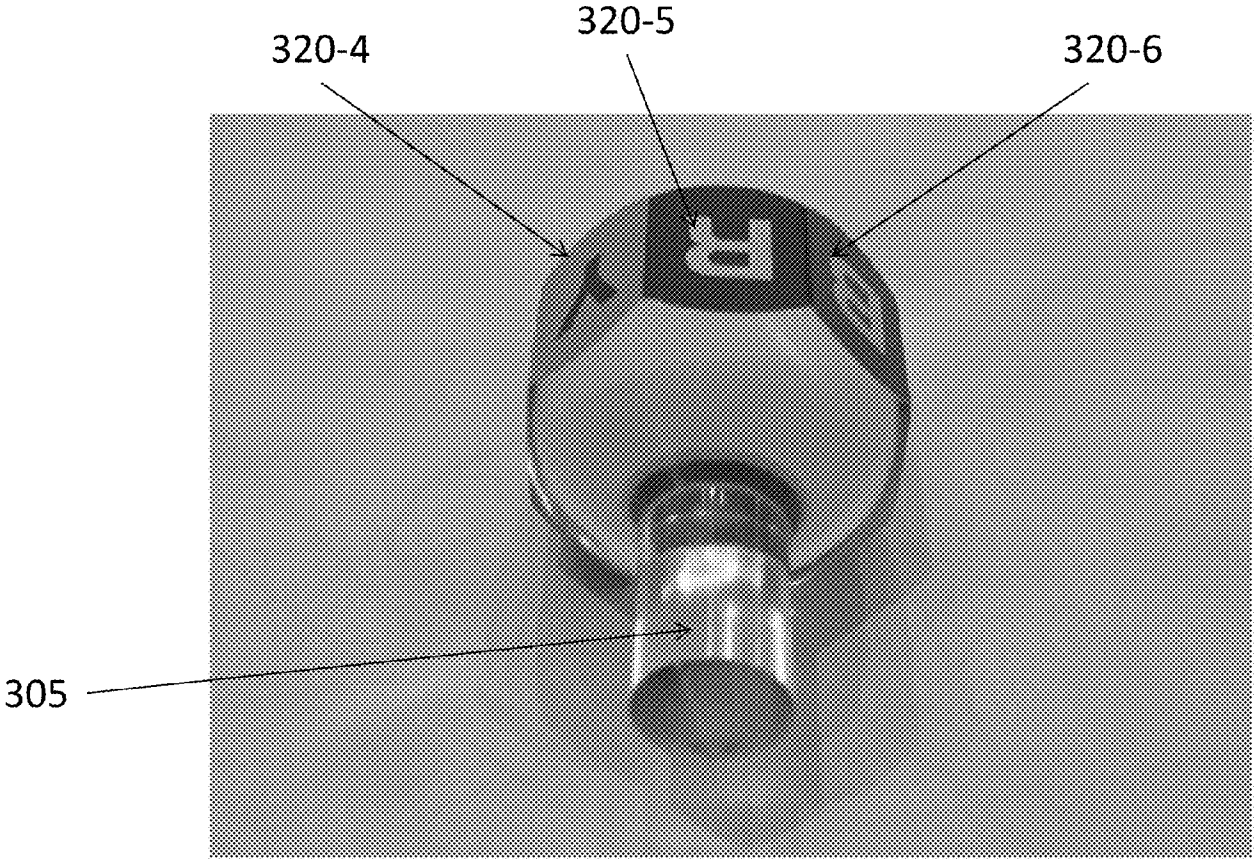
Figure 3D:
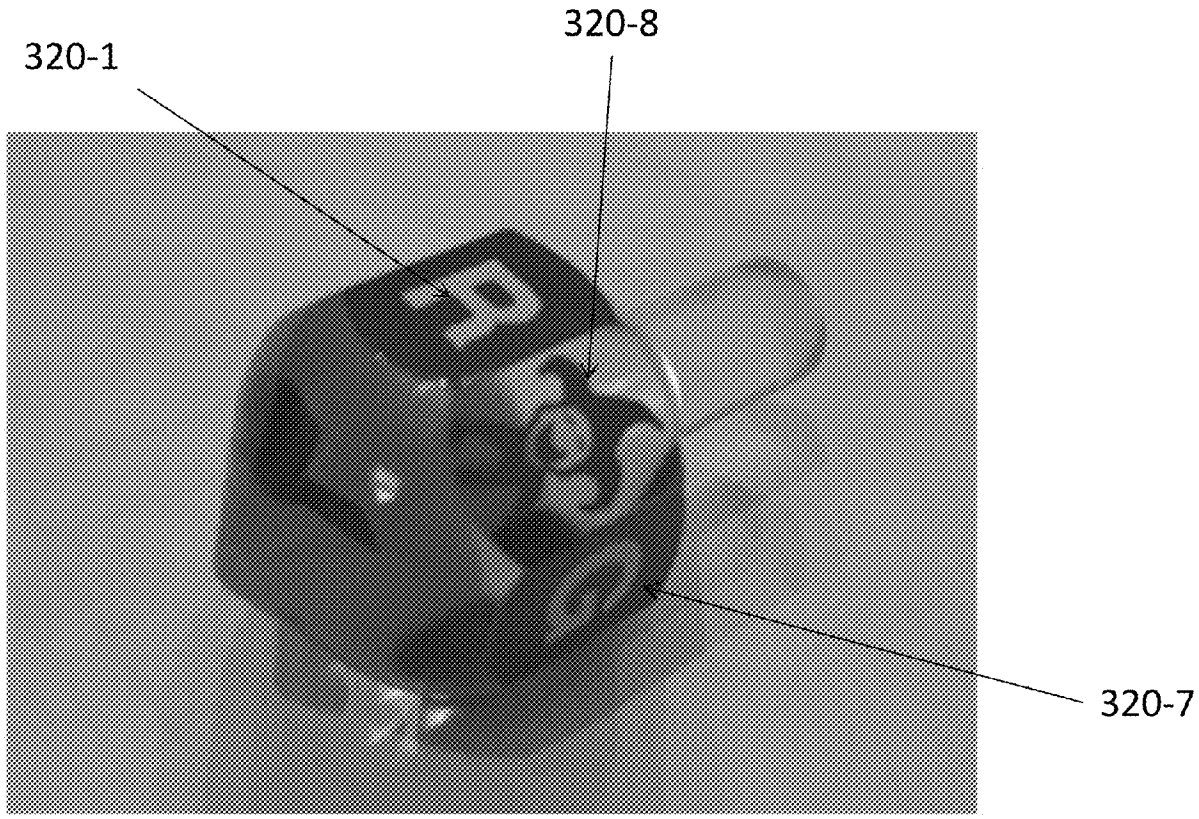

FIG. 2 shows a block diagram of a wireless system 200 which may be used to facilitate remote play of the game according to the embodiments of the present invention. The wireless system 200 comprises a game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith. Wired connections may be used as well.

FIGS. 3A through 3D show various views of a top 300 used to generate random outcomes. The top 300 cylindrical handle 305 via which a player is able to spin the top 300 between a thumb and index or middle finger. A top body 310 joins the handle 305. The body 310, from the handle 305 enlarges by a conical section 315 to a cylindrical, outer surface defining an octagonal pattern comprising eight flat facets 320-1 through 320-8. To maintain symmetry, in one embodiment, the flat facets 320-1 through 320-8 are dimensioned equally. In this manner, the possibility is equal that each side 320-1 through 320-8 ends face-up once the top is spun and topples. The body 310 conically tapers to a point 325 which is axially aligned along spin axis A. The top 300 is balanced about spin axis A to further assure the random generation of outcomes.

Each of the facets 320-1 through 320-8 defines a game outcome. In one embodiment, the top 300 includes two red facets, two blue facets, two green facets, a yellow facet and a joker ("wild") facet. The coloring of the facets may be facilitated by paints, inks, decals or any other suitable coloring means. Those skilled in the art will recognize that other indicia, including symbols and numbers, may be placed on the facets. In one embodiment, the top 300 is fabricated of acrylic or other high density material and is 2.7 inches tall with a 1.52 inch diameter conical section and 1 inch long handle. Those skilled in the art will recognize that the materials and dimensions (and number of facets) of the top 300 may be altered without departing from the spirit and scope of the present invention.

Operation of the top 300 is very straightforward and simple for players and dealers for reasons set forth below. A person grasps the top 300 by the handle 305 and spins the top 300 on the table layout 400. Eventually, due to influences of the gravity and friction, the top 300 topples landing on one of the flat facets 320-1 through 320-8 and causing an oppositely positioned flat facet 320-1 through 320-8 to appear face up. It is the face-up facet which corresponds to the random outcome color or symbol for the game.

Figure 4:
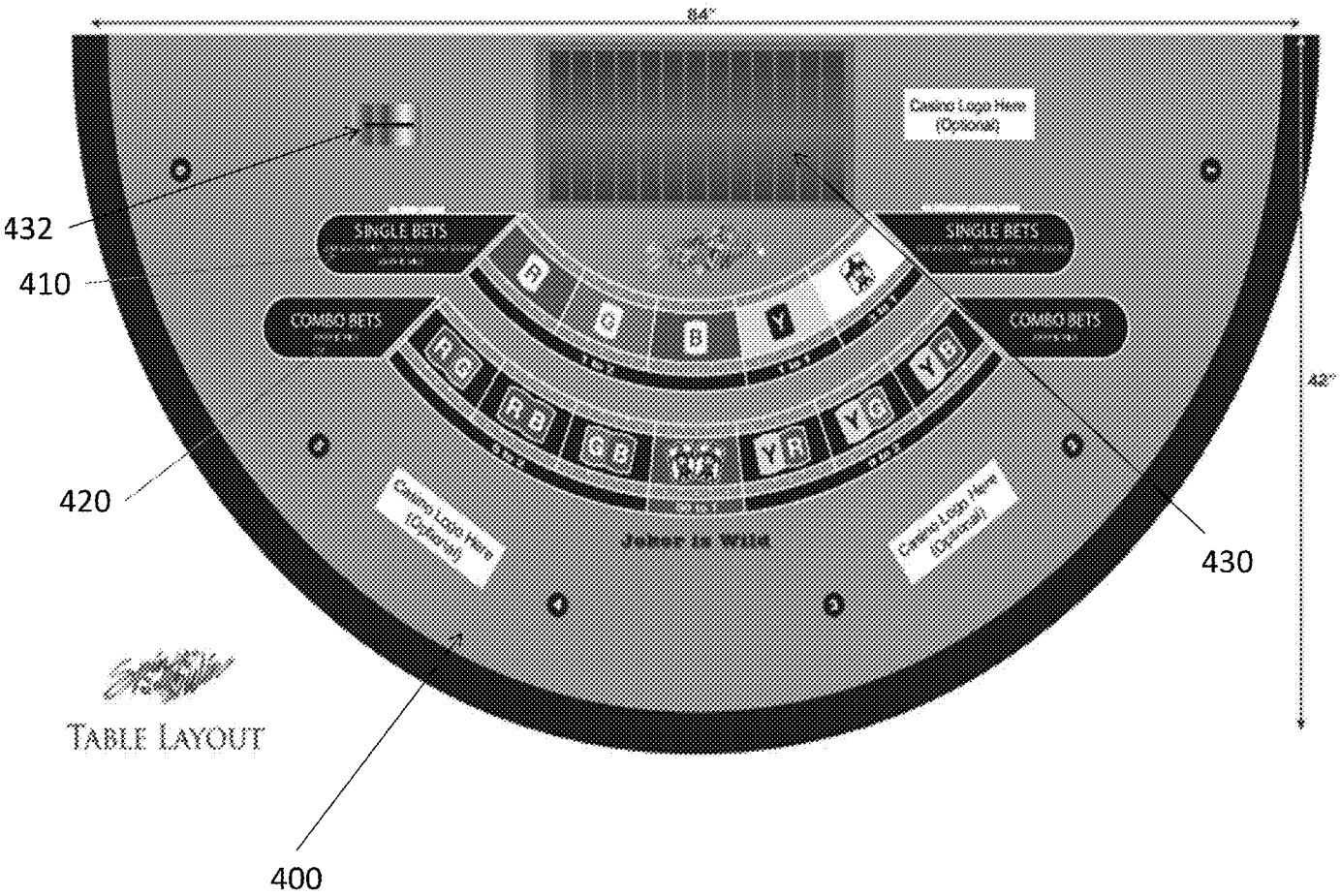
FIG. 4 illustrates a gaming table layout according to the embodiments of the present invention.

FIG. 4 shows a gaming table layout 400. The layout 400 is configured to cover the top of an accurate-shaped gaming table akin to a blackjack table and other casino game tables. The layout 400 depicts a single outcome wager area 410 comprising single wager outcomes and combo wager area 420 comprising combo wager outcomes. A chip rack 430 accommodates chips from which the dealer may pay winning wagers and store losing wagers. A chip drop slot 432 allows chips to be dropped into a table drop box in a well-known manner. As shown, the single wager outcomes comprise red, green, blue, yellow and joker from left to right from the players' perspective and the combo wager outcomes comprise red/green, red/blue, green/blue, joker/joker, yellow/red, yellow/green and yellow/blue from left to right from the players' perspective. In one embodiment, single wager outcomes for red, blue and green pay 1 to 2; single wager outcome for yellow pays 1 to 1 and single wager outcome for joker pays 3 to 1 for a single outcome (if the outcome appears on both tops, it pays double). In one embodiment, combo wager outcomes for red/green, red/blue and green/blue pay 5 to 2; combo wager outcome joker/joker pays 50 to 1 and combo wager outcomes yellow/red, yellow/green and yellow/blue pay 9 to 2. If two jokers appear all bets are automatic winners.

Combo wagers are paid responsive to specific combinations of outcomes occurring on spins of the two tops. For example, to win the 50 to 1 payout on the joker/joker combo wager requires the dealer and player to each spin a joker outcome. Similarly, a red/green combo wager is paid responsive to one red outcome and one green outcome regardless of whether the dealer or player spins the red or green outcome. Jokers are deemed wild such that all players win double on single outcome wagers responsive to the player or dealer spinning a joker. For example, if the dealer spins a red and the designated player spins a joker, the outcome is deemed two reds meaning single outcome wagers are paid double. In addition, a wager on a single outcome joker is paid 3 to 1.

In one embodiment, a display maintains records of a pre-established number of past outcomes of a plurality of consecutive games (akin to a roulette display). The display tracks outcomes of both tops as spun by the dealer and player.

Figure 5:
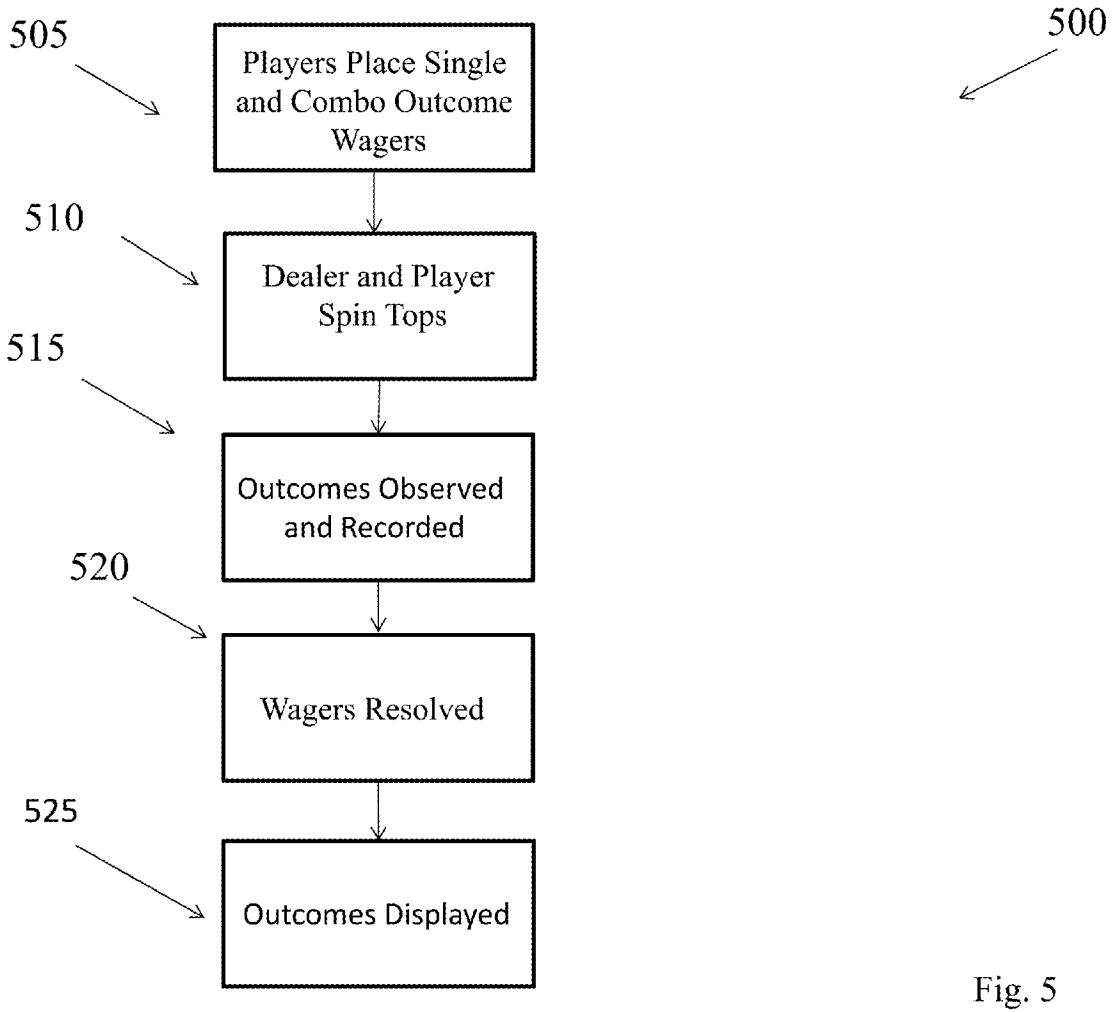
FIG. 5 illustrates a flow chart detailing one live system methodology of conducting a casino game according to the embodiments of the present invention.

FIG. 5 shows a flow chart 500 detailing one methodology for conducting a game utilizing two tops as described above. At 505, players place single outcome wagers and combo outcome wagers. At 510, a designated player and the dealer each spin a top simultaneously. At 515, the outcomes of each spinning top are observed and recorded by means of one or more pucks, markers or lighted table portions. At 520, winning single outcome wagers and combo outcome wagers are paid and losing single outcome wagers and combo outcome wagers are collected. At 525, the outcomes are optionally displayed. The game progresses in this manner. Designated players may continue spinning for a pre-established number of spins (e.g., 1) or as long as they win a wager or in any method desired by the operator/casino until the top is passed to a next player.

Figure 6A:
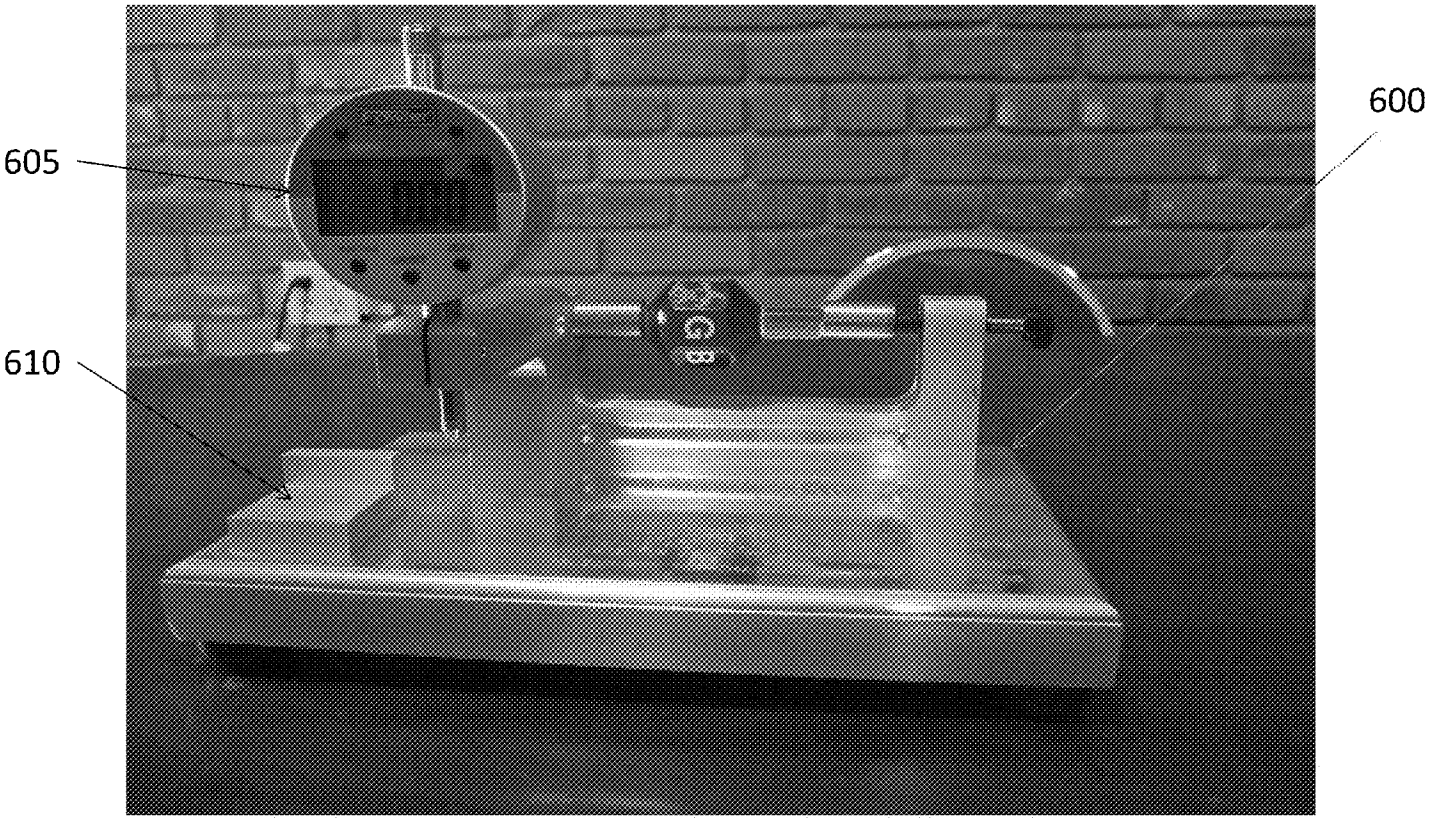
FIGS. 6A-6C illustrate views of a calibration/balance device for a top according to the embodiments of the present invention.
Figure 6B:
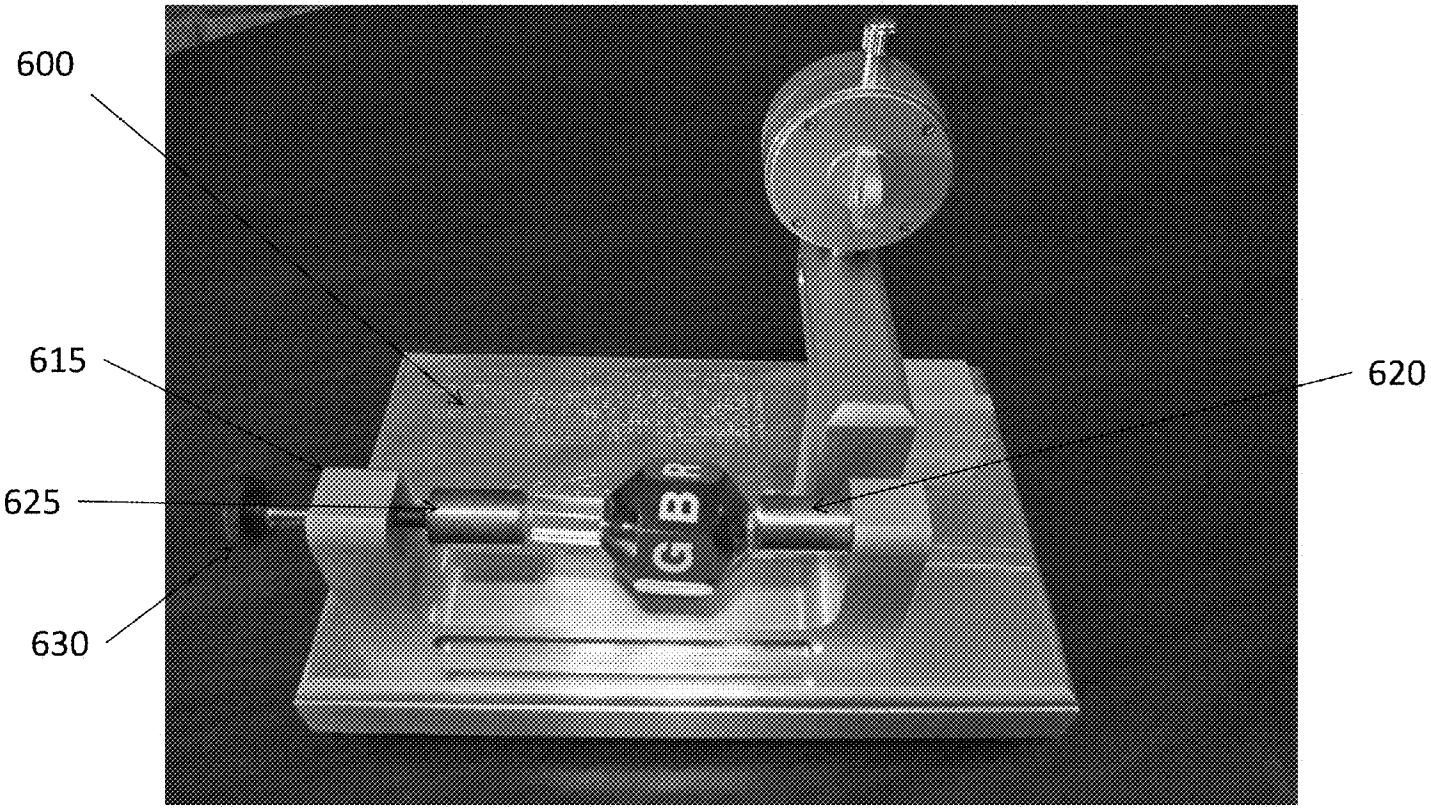
Figure 6C:
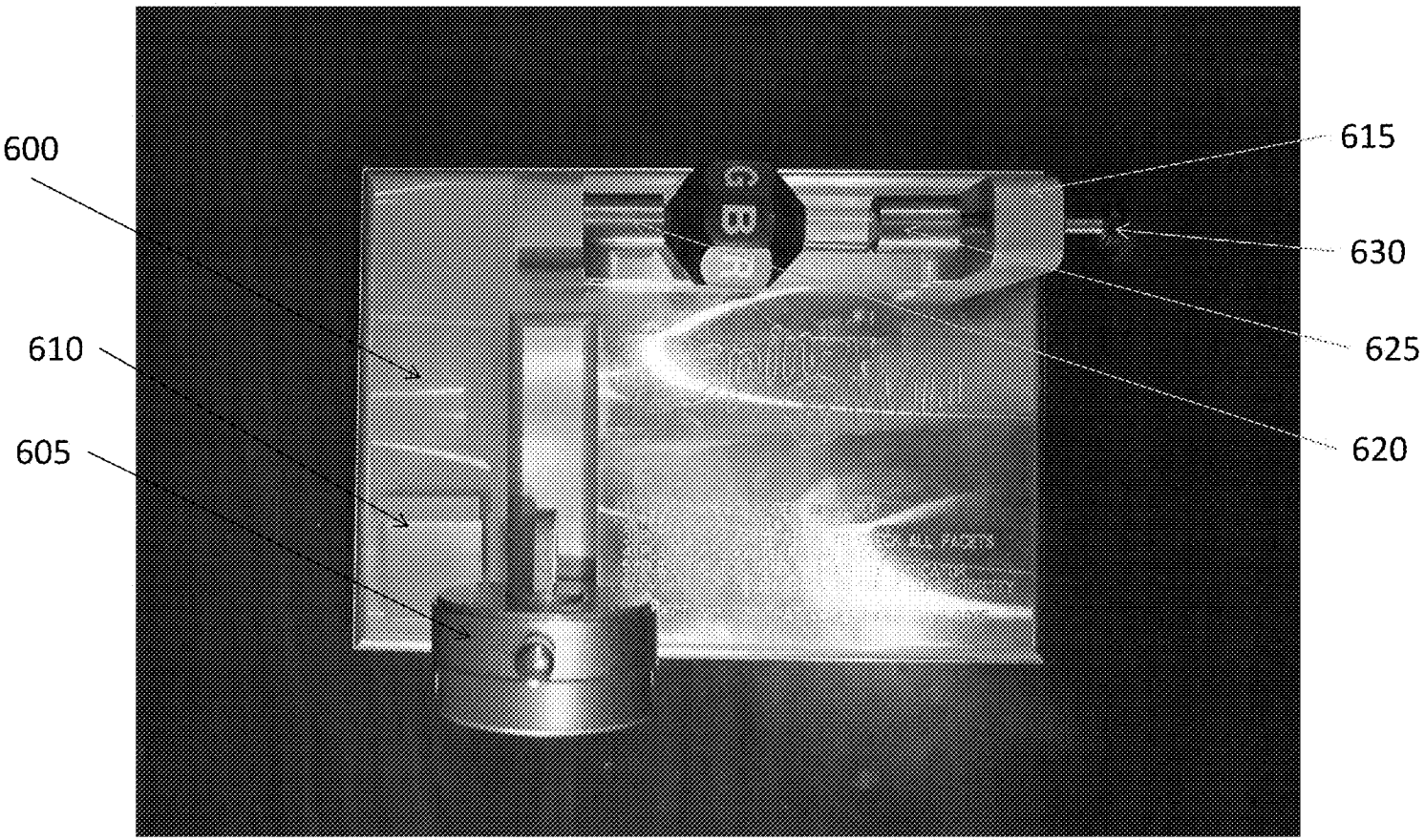

FIGS. 6A-6C illustrate views of a calibration/balance device 600 for tops 300 according to the embodiments of the present invention. The calibration/balance device 600 is used by operators, casinos and/or gaming commissions to make sure the tops 300 are functioning properly (i.e., providing truly random outcomes). The device 600 is configured to check the facets and concentricity. One operation of the calibration/balance device comprises: (i) sliding the top body under dial indicator 605; (ii) pressing "0" on the dial indicator setting the measurement of the first facet to a zero position; (iii) incrementally rotating the top three times (on each successive facet to measure each of the four planes of axis) thereby checking all facets; (iv) placing the top body on the raised block 610; (v) sliding the top handle under the dial indicator 605; (vi) incrementally rotating the top seven times to check concentricity. The calibration/balance device 300 rejects any top that varies more than 0.005".

The calibration/balance device 300 utilizes a mechanism 615 (for visual observation of the top) that contains a fixed horizontal post 620 with a cupped face to accept the handle or bottom point of a top. The opposite end contains a similar post 625 with a cupped face that can be loosened or tightened with a screw mechanism 630 to snugly affix a top and allow rotation of the top freely about its spin axis A (shown in FIG. 3A). The operator/casino ensures that a top spins freely about its spin axis and comes to a smooth random stop. Any weighting or gaffing of the top, not apparent by its clear acrylic design, is revealed when the top comes to rest at a favored facet. An imperfect top, will rock back and forth as it comes to rest with a heavy side face down. Any top displaying such anomalous behavior is destroyed by the operator/casino.

The embodiments of the present invention may also be implemented in an online, digital or virtual environment by system and method means represented in FIGS. 1 and 2. In such an embodiment, players access a dedicated gaming website and sign on to play at a virtual table. Appropriate software, memory and processor power control a pair of virtual, spinning tops. The outcomes of the tops are driven by a random number generator. Play of the game is the similar to that set forth in the flow chart 500 such that the programmed processor handles wager acceptance, spinning top outcomes, wager payouts and collections and passage of the player's top from player to player. Advantageously, and for purposes of excitement and anticipation, the electronic embodiment can display a virtual depiction of the two tops spinning prior to toppling and showing a depiction of the randomly determined outcome.

Accessing the online, digital or virtual environment is facilitated by electronic gaming devices including smart phones, tablets, laptops and desktops in a conventional manner via electronic user interfaces (e.g., touchscreen, keyboard, etc.). Standalone gaming devices such as slot machines may also be utilized to access a networked online, digital or virtual environment hereunder.

Figure 7:
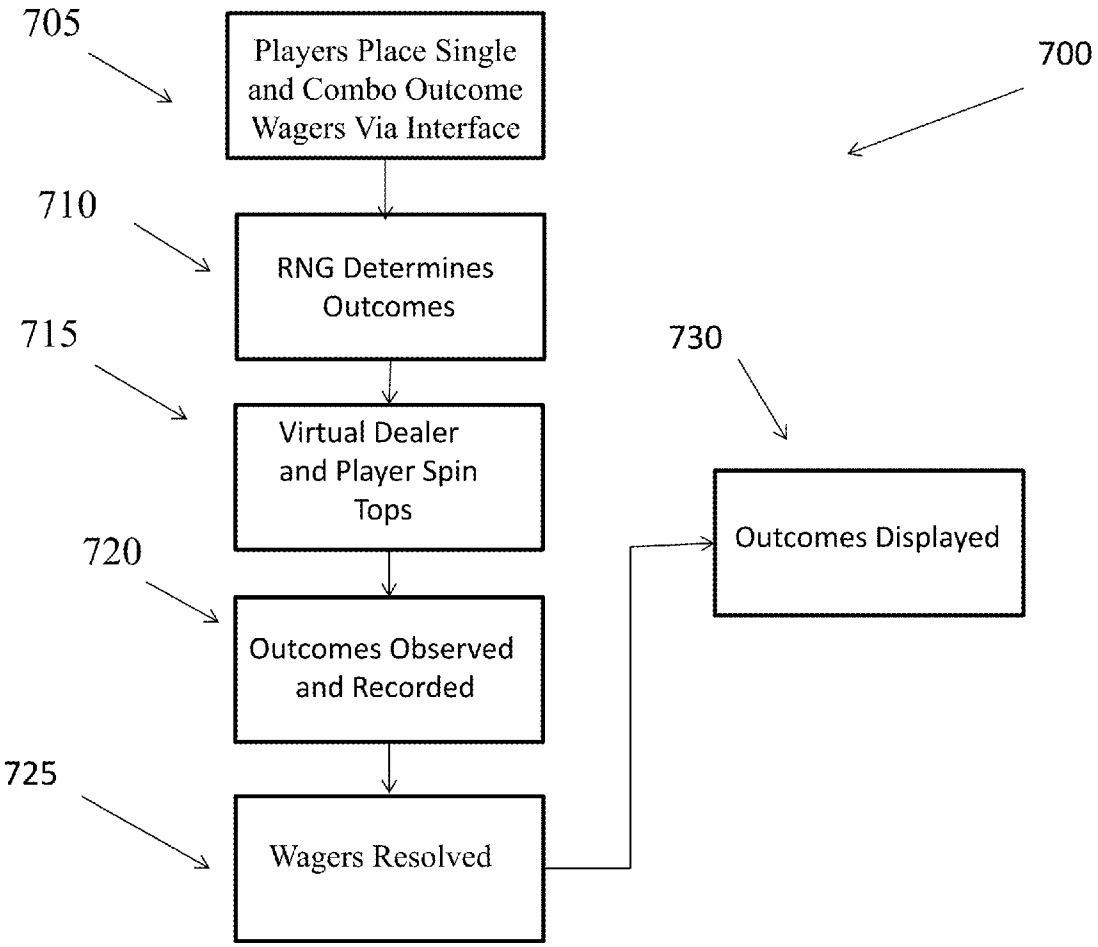
FIG. 7 illustrates a flow chart detailing one electronic system methodology of conducting a casino game according to the embodiments of the present invention.

FIG. 7 shows a flow chart 700 detailing one electronic system methodology of conducting a casino game according to the embodiments of the present invention. At 705, players place single outcome wagers and combo outcome wagers via a gaming device user interface such as a touchscreen. At 710, a random number generator controlled by a processor determines random outcomes for a virtual player's top and virtual dealer's top. This determination may be conducted during the spinning of the tops at 715 as well. Indeed, at any time prior to the spinning tops being shown toppling at 720. At 715, a designated player and the virtual dealer in the form of a programmed processor each cause two virtual tops to spin simultaneously on gaming device displays. The spinning of the tops may be dictated by a designated player input or pursuant to a timer. At 720, the outcomes of each virtual spinning top are presented (e.g., spinning tops shown toppling) on the displays of the electronic gaming devices and recorded by means of memory. At 725, a history of outcomes may be depicted on the displays of the electronic gaming devices. At 730, winning single outcome wagers and combo outcome wagers are paid and losing single outcome wagers and combo outcome wagers are collected. The game progresses in this manner. Designated players may continue spinning for a pre-established number of spins (e.g., 1) or as long as they win a wager or in any method desired by the operator/casino until the system passes the ability to cause the virtual tops to spin to a new player.

Although the invention has been described in detail with reference to several embodiments, additional variations and modifications exist within the scope and spirit of the invention as described and defined in the following claims.

We claim:

1. A system comprising:

a gaming table depicting single outcome wager areas, combo wager areas and associated payouts, said combo outcome wagers contingent upon consecutive game outcomes;

a dealer's top and a player's top, each of said dealer's top and player's top having a cylindrical handle and multiple facets each depicting a random outcome thereon such that said dealer's top and player's top are used to generate random outcomes from which single wagers and combo wagers are resolved; and means for recording single game outcomes generated by said dealer's top and player's top on said gaming table; and a device for calibrating said dealer's top and said player's top, said calibration device comprising at least a mechanism to retain said dealer's top or said player's top via said cylindrical handle and a bottom of said dealer's top or said player's top while allowing said top to spin such that any anomalous behavior is observed.

2. The system of claim 1 further comprising means for displaying past game outcomes.

3. The system of claim 1 wherein said dealer's top and said player's top have eight facets.

4. The system of claim 3 wherein said dealer's top and said player's top comprise two red facets, two green facets, two blue facets, one yellow facet and one joker facet.

* * * * *